US005514066A

United States Patent [19]

Monaco

[11] Patent Number: 5,514,066

[45] Date of Patent: May 7, 1996

[54] BUCKLE CHUTE FOLDING MACHINE FOR DIFFERENT LENGTH SHEETS

[75] Inventor: Sabatino M. Monaco, New Milford, Conn.

[73] Assignee: Pitney Bowes Inc., Stamford, Conn.

[21] Appl. No.: 299,396

[22] Filed: Sep. 1, 1994

[51] Int. Cl.[6] ..... B65H 45/14; B65H 45/12; B65H 45/18

[52] U.S. Cl. ..... 493/25; 493/420

[58] Field of Search ..... 493/419, 420, 493/421, 25, 8

[56] References Cited

U.S. PATENT DOCUMENTS

| | | | |
|---|---|---|---|
| 2,997,295 | 8/1961 | Beck | 270/62 |
| 3,265,382 | 8/1966 | Sherman | 493/420 |
| 3,416,785 | 12/1968 | Sherman | 493/420 |
| 3,698,705 | 10/1972 | Funk et al. | 493/420 |
| 3,975,009 | 8/1976 | Brown | 493/421 |
| 4,619,101 | 10/1986 | Havey, Jr. et al. | 493/421 |
| 4,834,695 | 5/1989 | Boblit et al. | 493/1 |
| 4,850,945 | 7/1989 | Whittenberger | 496/420 |
| 5,183,246 | 2/1993 | Edwards et al. | 270/45 |
| 5,242,369 | 9/1993 | Eschweiler, Jr. | 493/420 |
| 5,246,415 | 9/1993 | Fuss | 493/28 |
| 5,322,498 | 6/1994 | Lehmann et al. | 493/420 |
| 5,441,244 | 8/1995 | Bartoes et al. | 270/45 |
| 5,445,368 | 8/1995 | Lester et al. | 270/59 |

FOREIGN PATENT DOCUMENTS 2681847 4/1993 France .

*Primary Examiner*—Jack W. Lavinder
*Assistant Examiner*—Christopher W. Day
*Attorney, Agent, or Firm*—Angelo N. Chaclas; Charles R. Malandra, Jr.; Melvin J. Scolnick

[57] ABSTRACT

Disclosed is a sheet folding module for use in a sheet processing apparatus in which individual sheets are either separated from a continuous web or are stored in the processing apparatus as a stack of separate sheets in a sheet feeding module, and in which the individual sheets are fed along a feed path toward other sheet processing components, with the individual sheets being folded or left unfolded depending on the length thereof. The folding module has at least one buckle chute and a plurality of feeding and folding rollers which cause sheets to be folded which are long enough to be fed into the buckle chute and still remain under the control of a pair of rollers adjacent the entrance to the buckle chute. The buckle chute has a sheet ejecting mechanism which includes a movable back stop means which can be positioned in the path of movement of sheets or withdrawn from the path of movement of streets, and a movable sheet ejecting means which is operable to eject any sheets from the buckle chute which are too short to reach the normal position of the back stop and still remain under the control of the feed rollers.

14 Claims, 5 Drawing Sheets

BUCKLE CHUTE FOLDING MACHINE FOR DIFFERENT LENGTH SHEETS

BACKGROUND OF THE INVENTION

This invention relates generally to the field of folding machines for folding sheets of paper of different lengths into various fold configurations, and more particularly to a folding machine having the capability of either folding sheets of paper which exceed a predetermined minimum length or merely passing sheets through the machine without folding which are shorter than the predetermined minimum length.

The sheet folding machine of the present invention was designed and developed for use as a folding machine module to be incorporated into a sheet processing apparatus which performs several operations on sheets passing through the apparatus. Several forms of such apparatus as heretofore known are utilized to assemble together various forms of documents and to prepare them for mailing, typically operating on multiple sources of documents to feed, sever, fold, collate, insert and stack all in one continuous operation and at relatively high speed. A typical apparatus of this nature is used to assemble and prepare for mailing such items as telephone bills, credit card charge account bills, monthly bank statements, sweepstakes entries, and any of a variety of other examples where the finished mail piece includes a plurality of different sized items, only some of which are folded.

A typical apparatus of this nature would include several sheet processing modules or components each of which performs a particular function on sheets passing through the apparatus. For example, an apparatus for processing credit card charge account bills would include a pair of feeding devices for simultaneously feeding a pair of webs, each web having discrete forms or documents thereon separated by score lines, with the documents on one web being of a different length than the documents on the other. The webs are fed into a bursting module where they are separated from each other by bursting rollers, from where they are fed into an accumulator module where they are stacked in individual piles until the desired number of forms or documents from each web has been accumulated, all under the control of appropriate software. In some installations, only one web is involved, since the short documents are already in sheet form and are fed into the system from a sheet feeder, as more fully explained below. Thereafter, the sheets from each stack are fed through a folding module which folds the sheets from each stack into one of several different fold configurations as desired to fit into appropriate envelopes for mailing. After passing through the folding machine, the folded sheets from each stack are collated into a single pile, which is then either fed into an inserting module for inserting the folded collation directly into a mailing envelope, or it is passed into a collating module where additional material is added to the folded collation, after which it is fed to the inserting machine for insertion into an envelope. In a typical installation, the filled envelopes are then stacked and either manually or automatically fed to a mailing machine which closes and seals the flaps of the envelopes and prints an appropriate postage indicia on the face of each envelope.

The commercial advantage of such multi-function sheet processing apparatus, especially when operating at a high rate of speed, will immediately be apparent when one considers the tens of thousands, perhaps hundreds of thousands, of mail pieces as described above which are prepared and sent to customers each month by a single mailer. Obviously sheet processing apparatus of this nature is very complex to manufacture and therefore very costly, and has utility only in installations in which a very large number of individual mail pieces are assembled and prepared for mailing on a frequently repetitive basis. It is therefore of the utmost importance to enable the processing apparatus to operate at the highest possible speed and degree of reliability in terms of down time, either from maintenance or breakdown.

One aspect of certain sheet processing installations that has been the cause of a significant problem is that of handling sheets which are too short to be folded, or at least are of a sufficient short length that it is desired not to fold them prior to their being inserted into an envelope. As described above, a sheet folding module is one of the components of the sheet processing apparatus that is integrated into the system for handling all sheets being fed seriatim through the apparatus. Many modern day forms of multiple sheet mail pieces include forms or documents which are initially scored on the web sufficiently short that they will fit into a suitable mailing envelope without being folded. Also, in the case of bank statements, the cancelled checks of the bank customer that are normally included with the pages of the customer's statement are already short enough to fit into a mailing envelope and therefore are not folded. Thus, the problem that is presented is how to feed such short documents through the folding machine module without folding them and at the same time preventing them from jamming up in the folding machine because of their short length.

In conventional folding machines, which include one or more buckle chutes into which sheets are fed by a plurality of feeding and folding rollers, a sheet of given length is fed into the chute until the lead edge of the sheet abuts a fixed back stop which arrests further movement of the sheet while a substantial portion remains outside of the buckle chute. Continued rotation of the feed rollers forms a buckle in the sheet which is directed into the nip of a pair of rollers which forms a fold in the sheet. If additional folds are required, the partly folded sheet is fed into another buckle chute until the new lead edge abuts a fixed back stop which again arrests movement of the partly folded sheet while a substantial portion still remains outside of the buckle chute. A second buckle is now formed which is fed into the nip of another pair of rollers to form the second fold in the sheet, after which the sheet may be ejected from the folding machine. Folding machines of this type have long been well known and complete descriptions thereof are replete in the art.

During the preceding operation, the sheet is under the control of at least one pair of feeding and folding rollers at all times while it is in the folding machine. It should be apparent that if a sheet is fed into the folding machine that is too short to remain under the control of at least one pair of rollers while part of the sheet is in a buckle chute, the sheet will not exit from the buckle chute as it should under normal operating conditions, but rather will remain in the buckle chute and cause a serious paper jam in the buckle chute when further sheets are fed thereinto.

In some continuous sheet processing installations, this problem has been solved by providing an alternate feed path for sheets which are too short to be fed into the folding machine module and folded, the alternate feed path bypassing the folding machine module so as to deposit the short documents in collated fashion just downstream from the folding module. This solution requires a separate feeding module which is positioned outside of the normal feed path through the processing apparatus and is located therealong to continuously feed short documents into the feed path of the processing apparatus downstream from the folding module so that the short documents are collated with the folded documents in another accumulating module. This arrangement suffers the disadvantages of requiring additional hardware of substantial complexity, additional software and controls to coordinate the operation of the external feeding apparatus with the sheet processing apparatus, providing further opportunity for breakdowns, added cost, and diminished speed and efficiency due to the added step of having to separately collate short documents with longer folded documents in a separate step.

SUMMARY OF THE INVENTION

The present invention substantially alleviates, if not altogether eliminates, the problems and disadvantages mentioned, above as well as others, in the prior art continuous sheet processing apparatus which includes handling sheets which are too short to be fed through tile conventional folding machine modules. The present invention provides a unique way of feeding all lengths of sheets along the same feed path directly through the folding module regardless of whether or not they are to be folded, thereby completely eliminating the need for any form of external feeders or alternate feed paths.

In its broader aspects, the present invention is a sheet folding module for use in a sheet processing apparatus in which individual sheets are either separated from a continuous web of such sheets or are stored in the processing apparatus as a stack of separate sheets in a sheet feeding module, and in which the individual sheets are fed along a feed path toward other sheet processing components, the individual sheets being folded or left unfolded depending on tile length thereof prior to being collated with other folded or non-folded sheets for further processing. In this environment, the folding module of the present invention comprises at least one buckle chute disposed in operative association with the sheet feeding path of the sheet processing apparatus for receiving sheets fed seriatim thereto, the buckle chute having a pair of opposed planar walls disposed in closely spaced relationship to define a street receiving space therebetween, one lateral edge of the planar walls defining an entrance opening into the sheet receiving space. A plurality of feeding and folding rollers are disposed adjacent to the entrance opening into the sheet receiving space for feeding individual sheets into and out of the buckle chute for folding selected sheets in a predetermine fold pattern depending on the number and arrangement of buckle chutes and feed rollers in tile folding module. A sheet abutment means is movably mounted in the buckle chute and normally extends across the sheet receiving space in the path of movement of sheets thereinto to arrest the movement of selected sheets fed into the sheet receiving space which are long enough to span the distance between the feeding and folding rollers so as to remain under the control of the feeding and folding rollers when the lead edge of the sheets reaches the abutment means. A sheet ejecting means is also movably mounted in the buckle chute adjacent to the abutment means for ejecting sheets fed thereinto which are too short to span the distance between the feeding and folding rollers and therefore are not under the control of the feeding and folding rollers when the lead edge of the short sheets reach the abutment means. And there is an actuating means for moving the abutment means out of the sheet receiving space when a short sheet is directed into the buckle chute and for thereafter actuating the sheet ejecting means to eject the short sheet from the buckle chute, so that short sheets are ejected without being folded from the buckle chute back into the feeding and folding rollers to be ejected from the sheet folding module.

In some of its more limited aspects, the sheet abutment means comprises a plurality of sheet abutment fingers mounted on a first shaft operated by a rotary solenoid such that the fingers are moved between a first position in which the sheet abutment fingers are disposed across the sheet receiving space in the path of movement of sheets entering the buckle chute, and a second position in which the sheet abutment fingers are disposed out of the sheet receiving space so as not to obstruct sheets in the path of movement.

The sheet ejecting means comprises a plurality of sheet ejecting fingers mounted on a second shaft also operated by a rotary solenoid such that the fingers are moved between a first position in which the sheet ejecting fingers are disposed in rearwardly spaced relationship to the sheet abutment fingers relative to the buckle chute when the sheet abutment fingers are in their first position, and a second position in which the sheet ejecting fingers are disposed in forwardly spaced relationship to the first position thereof.

The movement of the sheet abutment fingers and the sheet ejecting fingers is under the control of an actuating means which is responsive to software which is part of the sheet processing apparatus which determines whether long sheets to be folded or short sheets which are not to be folded are being fed to the folding machine at a given time, the actuating means also controlling the timed sequence of the movement of the abutment fingers and the ejecting fingers to properly eject a short sheet from the buckle chute.

Having briefly described the general nature of the present invention, it is a principal object thereof to provide a sheet folding module for a sheet processing apparatus which has the capability of folding or not folding sheets fed through the folding module depending on tile length of the sheets.

It is another object of the present invention to provide a sheet folding module for a sheet processing apparatus in which short length sheets which are not to be folded can be fed through the folding module in a predetermined sequence with long sheets which are to be folded so that sheets of any length can be fed through the same feed path in the folding module.

It is still another object of the present invention to provide a sheet folding module for a sheet processing apparatus which retains positive control over short sheets being fed into buckle chutes even though the sheets are too short to remain under the control of feeding rollers when the short sheets are in the buckle chutes.

It is a still further object of the present invention to provide a sheet folding module for a sheet processing apparatus which is relatively simple in construction, highly reliable in operation and easily maintained and serviced at an installation cite.

These and other objects and advantages of the present invention will be more apparent from an understanding of the following detailed description of a presently preferred embodiment of the invention when considered in conjunction with the accompanying drawings.

DETAILED DESCRIPTION OF THE INVENTION

Figure 1:
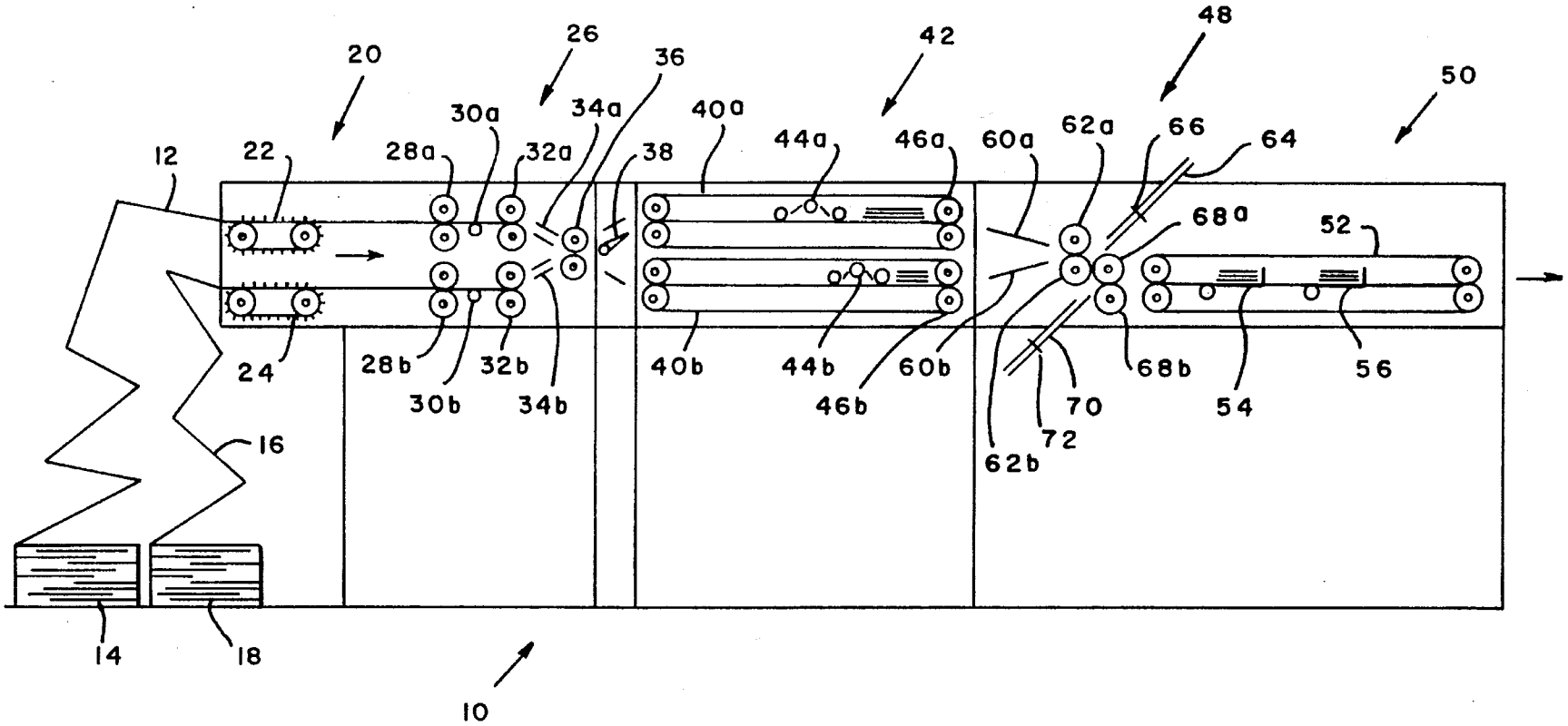
FIG. 1 is a diagrammatic side view of a major portion of a typical sheet processing apparatus which incorporates the sheet folding module of the present invention.

Referring now to the drawings, and particularly to FIG. 1, there is seen a representative sheet processing apparatus, indicated generally by the reference numeral 10, which is shown diagramatically and includes only so much detail as is necessary for an understanding of the utility and operation of the present invention. Although other general configurations can be utilized, the apparatus 10 shown in FIG. 1 is intended to assemble sheets of different length from two different webs, the sheets from one web being long enough to require folding while the sheets from the other web being short enough to fit into a mailing envelope without requiring folding.

The sheets to be processed in the representative apparatus 10 are initially in the form of webs and are separated thereon by score lines which separate the sheets from each other and which facilitate separation of the sheets as described below. For the sake of illustration, a first web 12 contains sheets which are of normal 8½ by 11 inch size arid which must be folded into, three sections in order to fit into a standard No. 10 envelope. The web 12 is normally stored in a fan-fold configuration as indicated by the numeral 14. Another web 16 contains sheets which are only four inches in length from lead edge to trailing edge in the direction of movement, and therefore will fit into a No. 10 mailing envelope without folding. The web 16 is also normally stored in a fan-fold configuration as indicated by the numeral 18.

The webs 12 and 16 are first drawn into a feeding module, indicated generally by the reference numeral 20, which withdraws the webs 12 and 16 from the fan-fold stacks 14 and 18 and feeds the webs 12 and 16 into the sheet processing apparatus 10. Both webs are engaged by feeding units, typically pin feeders of well known construction, such as shown by the pin feeder 22 for the web 12 and the pin feeder 24 for the web 16. The feeders 22 and 24 feed the webs 12 and 16 to a bursting module, indicated generally by the reference numeral 26, of which several types are well known in the art, but for the sake of illustration in FIG. 1, includes a pair of bursting rollers **28*a* and 28*b* for the webs 12 and 16 respectively, a bursting cone 30*a* and 30*b* for the web 12 and 16 respectively, and a pair of feeding rollers 32*a* and 32*b* for the webs 12 and 16 respectively. As is well known in the art, at the instant that a score line in the web between two adjacent documents is over the burst cone 30*a* or 30*b*, the bursting rollers 28*a* and 28*b*** are momentarily decelerated in order to impose a momentary tension on the web of sufficient force to snap or burst the lead sheet or document from tile next adjacent sheet or document.

It should be noted that it is not essential to the operation of the apparatus 10 that there be two webs, since it may occasionally be desirable to feed individual sheets into the system to be collated with sheets severed from a web. For example, in the case of customer bank statements, it is standard procedure for the customer's bank to return his cancelled checks with his monthly statement. In this situation, the checks represent short sheets which would not be folded, but rather would be interleaved with one or more larger sheets of paper initially printed on a web and separated therefrom and which would require folding. In this type of installation, the apparatus 10 would be provided with an individual sheet feeder which would replace one of the web feeders and bursting assemblies, typically the upper since this area of the apparatus is more accessible, and which would feed the checks (or other short documents, as the case may be) into the system in the same manner as they would have been by the web feeder and bursting assembly.

The individual sheets from the webs 12 and 16 are then fed between suitable guides **34*a* and 34*b* which direct them to a single pair of feed rollers 36 which feed the sheets to a movable deflector 38 which call redirect the sheets either to all upper or lower transport assembly 40*a* or 40*b* of a dual accumulator module, indicated generally by the reference numeral 42. The accumulator module 42 receives and stacks one or a plurality of sheets from either web under the control of suitable software which in turn controls the position of the movable deflector 38. The accumulator 42 includes adjustable stacking devices 44*a* and 44*b* which can be set to stack any combination of long sheets, short sheets or both. The accumulator also includes two pairs of clutch/brake roller assemblies 46*a* and 46*b* which control the feeding of the stacked sheets from each web to the folding module, indicated generally by the reference numeral 48. For example, if we assume that the web 12 has long sheets which are to be folded and the web 16 has short sheets which are not to be folded, and the desired mail piece for one or any number of individual customers is 2 long sheets and 5 short sheets, the apparatus 10 is suitably programmed to feed 2 sheets from the upper web 12 and, after bursting, to direct,these sheets into either the upper or lower transport assembly 40*a* or 40*b* by the deflector 38, let us assume the upper. As soon as these sheets have been burst and fed, 5 sheets are fed and burst from the lower web 16 and are directed by the deflector 38 into the lower transport assembly 40*b*. While this is happening, the two sheets from the upper transport assembly 40*a* have been fed into the folding module 48 and are folded. As soon as the 5 sheets from the lower web 16 are burst and fed to the lower transport assembly 40*b*, the deflector 38 shifts and 2 more long sheets are fed into the upper transport assembly 40*a*, during which the 5 sheets from the lower transport assembly 40*b* are fed into the folding module. Thus, feeding, stacking and folding, or passing through the folding module 42** without stacking, as the case may be, continues in almost a continuous operation.

Since the folding module 48 is the principal subject matter of the present invention, a complete description thereof is set forth below in conjunction with the other views of the drawings. To complete the description of the environment of the present invention, however, it should be noted at this point that after the folded or unfolded sheets, whether individual or multiple, are ejected from the folding module 48, they are collected in a staging unit, indicated generally by the reference numeral 50, which includes a suitable transport assembly 52 and a plurality of suitable collecting devices 54 and 56 which collect and hold the now assembled and folded group of sheets which are then fed to a suitable envelope stuffing module (not shown) for insertion into mailing envelopes.

It will be apparent from the foregoing description that the apparatus 10 is typically very large, extending some 15 to 20 feet, occasionally more, especially if the envelope stuffing and the mailing machine modules are included, highly complex and very costly, and can be commercially justified only by extremely large mailers who have sufficiently large mailing operations that the apparatus can be kept running continuously, at a high rate of speed and with absolutely minimal down time due to maintenance or breakdown. Thus, it is apparent that every module in the system must meet these criteria in order for the apparatus to enjoy commercial success.

Turning now to a general description of the sheet folding module 48 as it is associated with the sheet processing apparatus 10, it will be seen from FIG. 1 that the individual sheets, or collated stacks of sheets, as the case may be, are fed by the rollers 46*a* and 46*b* into suitable guide assemblies 60*a* and 60*b* which direct the sheets into the nip of a first pair of feeding rollers 62*a* and 62*b*, which in turn feed the sheets into a first buckle chute 64 until the lead edge of the sheet abuts an adjustable back stop 66. When this happens, a buckle forms in the sheet between the lower roller 62*b* and the upper roller 68*a* of a second pair of feeding rollers 68*a* and 68*b*, which is forced between the nip of the rollers 62*b* and 68*a* to form a crease, which now becomes the new leading edge of the partially folded sheet. This lead edge is directed to a second buckle chute 70 until the lead edge abuts an adjustable back stop 72. When this happens, another crease is formed between the upper and lower rollers 68*a* and 68*b*, which is forced between the nip of these rollers to form another crease in the sheet. The back stops 66 and 72 are adjustable along the length of the buckle chutes 64 and 70 in order to control the type of fold configuration that is produced in the folding module 48. These rollers also feed the folded sheet out of the folding module 48 and into the transport assembly 52 of the staging module 50.

It should now be apparent that if a sheet is inserted into one of the buckle chutes 64 or 70 that is not intended to be folded and its length in the longitudinal direction of movement is too short reach the back stops 66 or 72 and still remain within the nip of the rollers 62*b* and 68*a* or 68*a* and 68*b*, as the case may be, that sheet will remain in the buckle chute since it is no longer under the control of either pair of rollers and therefore cannot be extracted from the buckle chute. Thus, in an installation without the present invention, it is impossible to feed such short sheets along the same path as longer sheets which are to be folded without causing a jam in the folding module. The fact that the back stops 66 and 72 are adjustable for controlling the fold configuration does not solve the problem because if they are moved toward the entrance of the buckle chute far enough to permit either pair of feed rollers to maintain control over the short sheets, they will then be folded in the same manner as longer sheets, which is contrary to what is desired. The present invention solves this problem in the manner now to be described.

Figure 2:
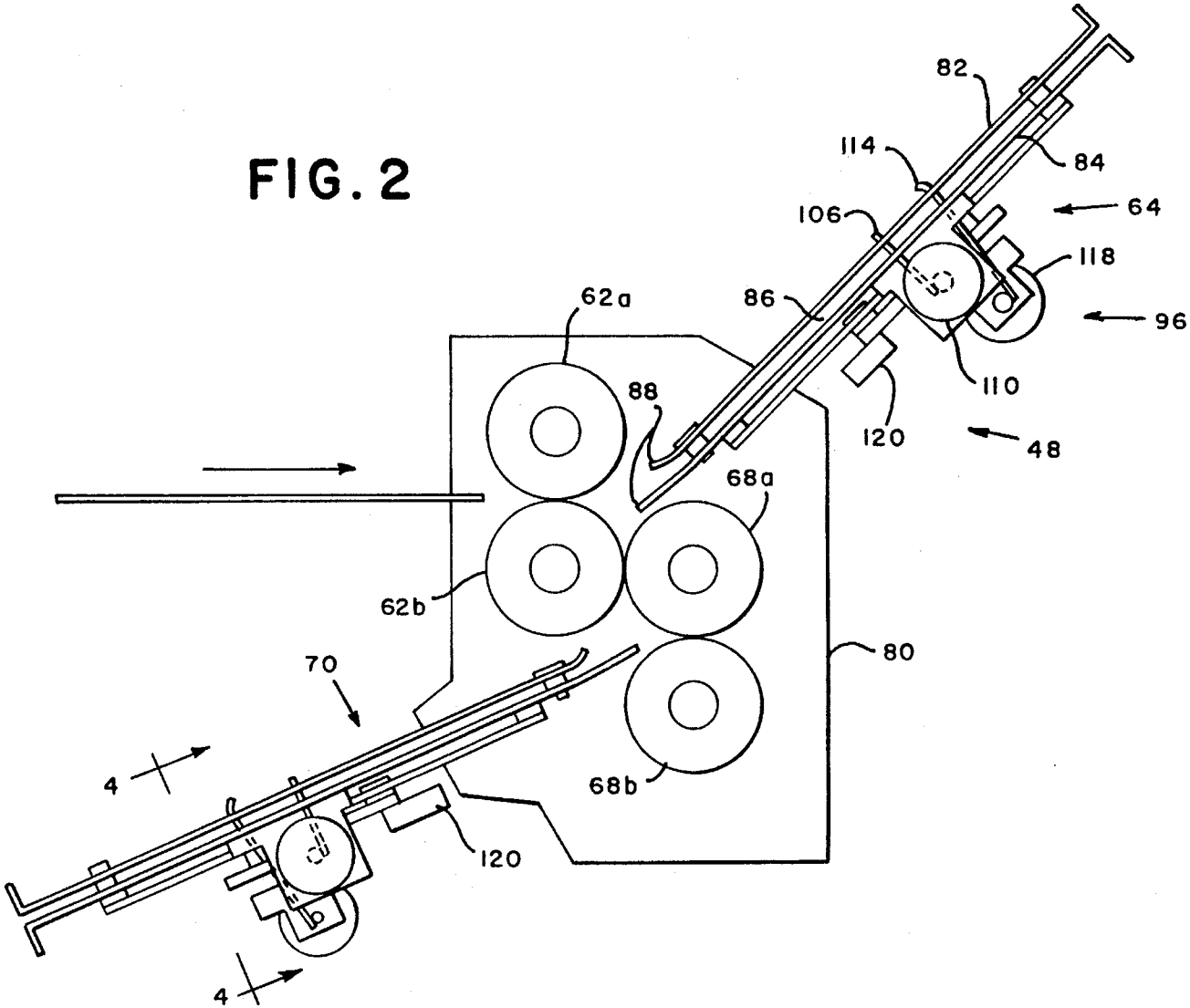
FIG. 2 is side view of a representative sheet folding module as shown in FIG. 1 but drawn to a larger scale, showing two buckle chutes and two pairs of feeding and folding rollers.

Turning now to FIGS. 2 through 5 for a more detailed description of the folding module 48, and referring first to FIG. 2, the folding module 48 comprises a suitable frame which includes a pair of spaced apart side plates 80 having suitable bearing means for rotatably mounting the aforementioned rollers 62*a*, 62*b*, 68*a* and 68*b*. The side plates 80 also include suitable means for receiving a latching assembly (further described below) which permits the buckle chutes, indicated generally in FIG. 2 by the same reference numerals 64 and 70 used in FIG. 1, to be removably mounted between the plates 80. Since the buckle chutes 64 and 70 are identical in all respects, except for the positions they occupy in the folding module 48, further description of the invention will be made with reference to the buckle chute 64.

Figure 3:
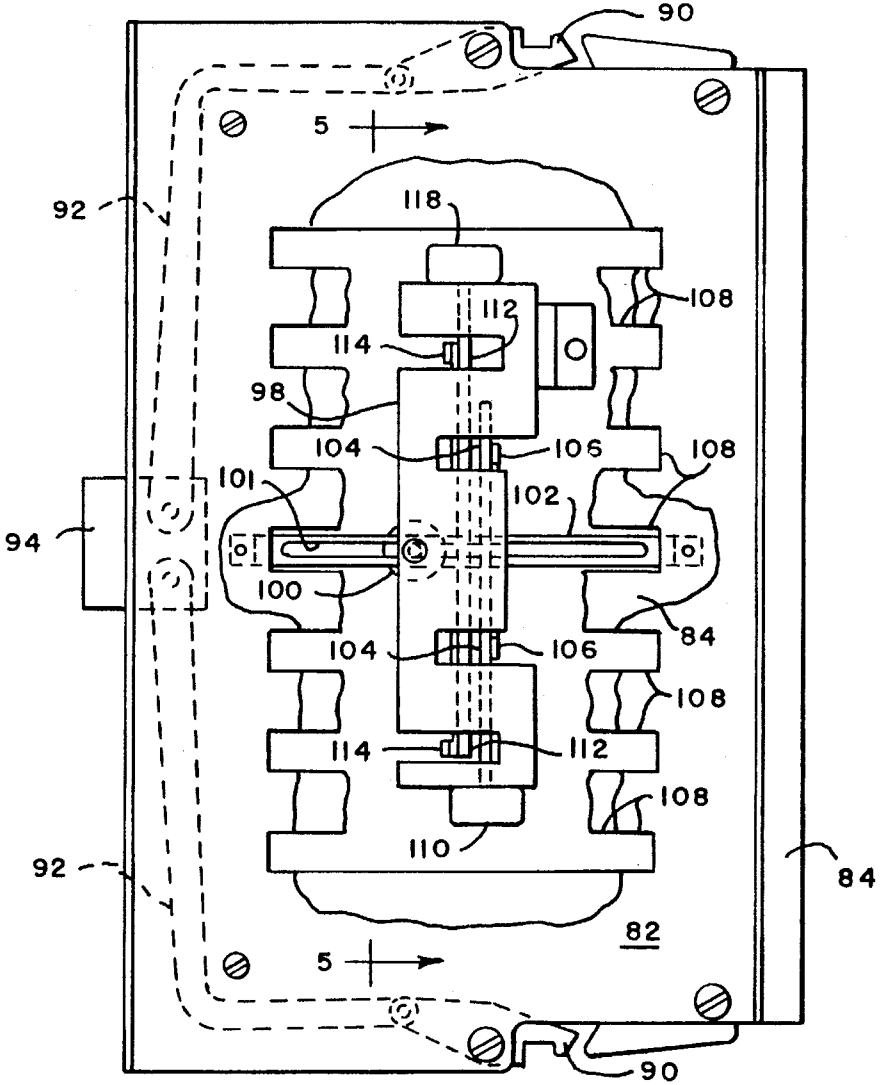
FIG. 3 is a bottom view of one of the buckle chutes shown in FIG. 2 incorporating the novel sheet backstop and ejecting mechanism of the present invention.

The buckle chute 64 include a pair of opposed planar walls 82 and 84 which are disposed in closely spaced parallel relationship to define a sheet receiving space 86 therebetween, each of the walls 82 and 84 having a forward lateral edge 88 to define an entrance opening into the sheet receiving space 86. As best seen in FIG. 3, the buckle chute 64 includes a latch assembly for removing and attaching the buckle chute to the side plates 80, the latch assembly comprising a pair of latching hooks 90 which are pivotally mounted on one of the walls 82 or 84, and which are connected at their opposite ends to a pair of bell cranks 92 which lie between the walls 82 or 84, the other ends of the bell cranks 92 being connected to a spring biased actuator 94. By depressing the actuator 94 against the spring bias, the bell cranks 92 are rotated to cause the latch hooks 90 to pivot inwardly of the buckle chute 64 in order to disengage the latch hooks 90 from the means on the plates 80 for receiving the latch hooks 90.

Figure 4:
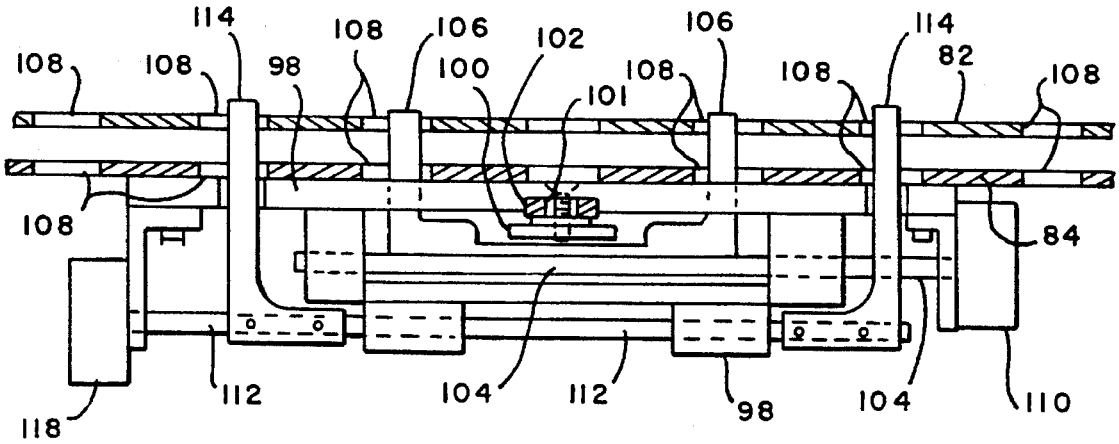
FIG. 4 is a rear view, partly in section taken on the line 4—4 of FIG. 2 of the buckle chute shown in FIG. 3.
Figure 5:
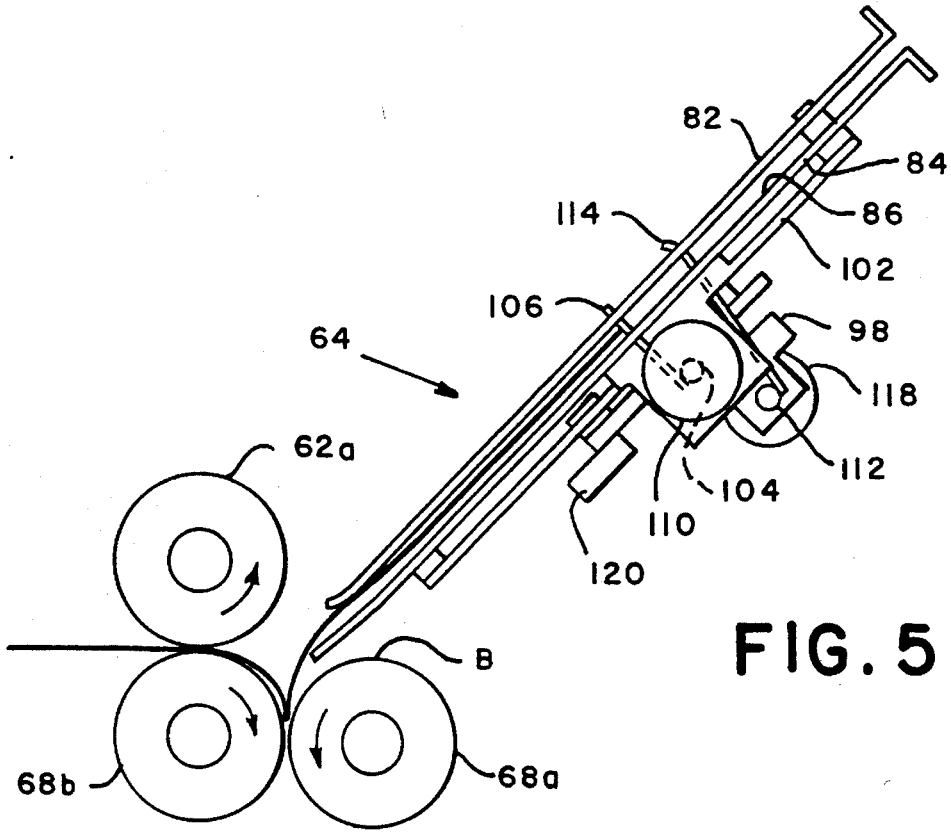
FIG. 5 is a vertical section taken on the line 5—5 of FIG. 3, showing the lead edge of a long sheet abuting the sheet abutment fingers, with the sheet abutment fingers and the sheet ejecting fingers in their first position.

The folding module of the present invention includes a novel sheet bouncing or ejecting assembly, indicated generally in FIG. 2 by the reference numeral 96, and which provides alternatively a back stop for arresting movement of long sheets into the buckle chute to cause the sheet to buckle and be folded as described above, and a bouncing or ejecting device for ejecting short sheets which are fed into the buckle chute and which are not intended to be folded. As best seen in FIGS. 3–5, the bouncing and ejecting assembly 96 comprises an elongate, generally U-shaped body member 98 which extends laterally of the buckle chute 64 and is slidably secured to the lower wall 84 of the buckle chute 64 by means of a thumb screw 100 which extends through a slot 101 formed in an elongate strip 102 which extends substantially the full length of the buckle chute 64 and is suitably secured to the underside of the lower wall 84, the body member 98 having a groove formed therein to accommodate the strip 102. The thumb screw 100 is threaded into an aperture formed in the body member 98 to lock the body member 98 against movement along the strip 102 when the thumb screw 100 is tightened, and to permit movement of the body member 98 along the strip when the thumb screw 100 is loosened. This permits the abutment fingers and ejecting fingers (further described below) to be set to various positions along the buckle chute depending on the length of the sheets to be folded and the fold configuration desired.

As best seen in FIG. 4, a first elongate shaft 104 is rotatably mounted in an intermediate portion of the body member 98 and extends along a substantial portion of the width of the buckle chute 64. A plurality of sheet abutment fingers 106 are mounted on the shaft 104 and extend upwardly through a plurality of elongate slots 108 formed in the walls 82 and 84 of the buckle chute 64 so as to extend across the sheet receiving space 86 between the walls 82 and 84 to arrest the movement of a sheet in the sheet receiving space 86.

One end of the shaft 104 is connected to a first rotary solenoid 110 which is suitably mounted on the body member 98 adjacent one end thereof. When energized, the solenoid 110 rotates the shaft 104 through approximately a 45° angle which is sufficient to move the abutment fingers 106 from a first position in which they extend across the sheet receiving space 86 between the walls 82 and 84, as seen in FIG. 5, to a second position in which the upper end of the abutment fingers 106 are below the level of the lower wall 84 so as to move the abutment fingers 106 entirely out of the sheet receiving space and therefore out of abutting engagement with a sheet passing into the buckle chute 64. A suitable resilient means, such as a torsion or tension spring, normally maintains the shaft in a non-energized position in which the abutment fingers extend across the sheet receiving space 86.

A second elongate shaft 112 is rotatably mounted in a lower portion of the body member 98 and also extends along a major portion of the width of the buckle chute 64. A plurality of sheet ejecting fingers 114 are mounted on the shaft 112 and also extend upwardly through the slots 108 to extend across the sheet receiving space 86, and are normally disposed in rearwardly spaced relationship to the abutment fingers. 106 relative to the buckle chute 64 when the sheet abutment fingers 106 are in their first position, as seen in solid lines in FIG. 5. The sheet ejecting fingers 114 also extend through the sheet receiving space 86.

One end of the shaft 112 is connected to a second rotary solenoid 118 which is suitably mounted on the body member 98 adjacent the end thereof opposite to the end that the first solenoid 110 is mounted on. When energized, the solenoid 118 rotates the shaft 112 very quickly through approximately a 35° angle which is sufficient to cause the ejecting fingers 114 to move from the first position described above to a second position in which the ejecting fingers 114 are disposed in forwardly spaced relationship to the first position, as seen in dotted lines in FIG. 6, to engage the edge of a sheet that is innermost in the buckle chute 64 and abruptly push the sheet out of the buckle chute and back into the nip of the feed rollers 62*a* and 68*a*. Again, a suitable resilient means, such as a torsion or tension spring, normally maintains the shaft in a non-energized position in which the ejecting fingers 114 are in their first position.

The first and second rotary solenoids 110 and 118 are controlled by a combination of system software for the sheet processing apparatus 10 and an actuator which is part of the sheet ejecting assembly 96. The sheet processing apparatus 10 is provided with a software controlled microprocessor which has been programmed in accordance with the sequence of long sheets to be folded and short sheets to be left unfolded, also taking into account whether long and, short sheets are fed to the folding module 48 individually or in pre-collated packages. Thus, once the desired sequence has been established, the system microprocessor controls the first solenoid 110 to either remain unenergized while long sheets are being fed to the folding module 48, thereby maintaining the abutment fingers 106 in their first position, or to become energized while short sheets are being fed to the folding module 48, thereby moving the abutment fingers 106 to their second position to permit the sheets to pass by the abutment fingers 106.

The second solenoid 118 is under the control of a suitable actuator 120 mounted on the body member 98 beneath one of the slots 108, the actuator 120 being, any of a variety of devices that will sense the presence or absence of a sheet of paper, such as a photocell, mechanical sensor, proximity sensor, etc. The actuator 120 senses that the lead edge of a sheet has arrived at a first predetermined location in the buckle chute 64 and then energizes the second solenoid 118 so as to abruptly move the sheet ejecting fingers 114 from their first position to their second position in timed sequence with the arrival of the lead edge of the sheet at a second predetermined location, so that the fingers 114 strike the edge of the sheet at the proper instant and bounce the sheet back into the normal feed path through the feed rollers 62*a* and 68*a*.

The operation of the folding module 48 will now be described in connection with a typical mailing operation in which the mail package consists of 2 sheets of standard 8½ by 11 inch size, preprinted in web form, are to be folded in a tri-fold configuration, and four sheets of a smaller size, for example 8½ by 4 inches, also pre-printed in web form, are to be left unfolded and are to be collated with the larger sheets and inserted into one of the folds of the larger sheets. Assuming that the web 12 contains the larger sheets and the web 14 contains the smaller sheets, the system software will have been programmed to cause the feeding device 22 to feed sequentially the number of large sheets required for each individual customer, and the feeding device 24 to feed sequentially the number of short sheets required for each individual customer, the feeding devices operating in a timed sequence also under the control of the system software. After passing through the appropriate bursting rollers, the deflector 38 will deflect the long and short sheets into one or the other of the stacking devices 44*a* or 44*b* of the accumulator 42, where the long and short sheets are interleaved in any desired pattern. For the sake of illustration, let us assume that the upper stack in the stacking device 44*a* contains only long sheets and the lower stacking device 44*b* contains only short sheets. At the appropriate time in accordance with the software controlled sequence, the long sheets are fed into the folding module 48 to be folded, either one sheet at a time or any plurality desired up to the maximum folding capacity of the folding module 48. Again for the sake of illustration, assuming that only one sheet is fed at a time, the sheet is fed by the rollers 62*a* and 62*b* into the entrance opening of the upper buckle chute 64 defined by the forward edges 88 and into the sheet receiving space 86 therein until the lead edge of the sheet abuts the abutment fingers 104. This arrests movement of the sheet in the buckle chute and causes a buckle B (see FIG. 5) to form adjacent the rollers 62*b* and 68*a*, which is forced between the rollers 62*b* and 68*a* by continued feeding of the sheet by the rollers 62*a* and 62*b*, thereby forming a crease in the sheet. The new lead edge of the sheet formed by the crease is now directed into the lower buckle chute 70 where the same operation as just described takes place, thereby forming a second buckle between the rollers 68a and 68b which impart a second crease to the sheet (tills latter folding operation is not shown since it is identical to the folding operation described above). The folded sheet is now directed by the rollers 68*a* and 68*b* into the staging unit 50 for further stacking and awaiting of the short sheets, which will be stacked with the long sheets and inserted into a mailing envelope.

Figure 6:
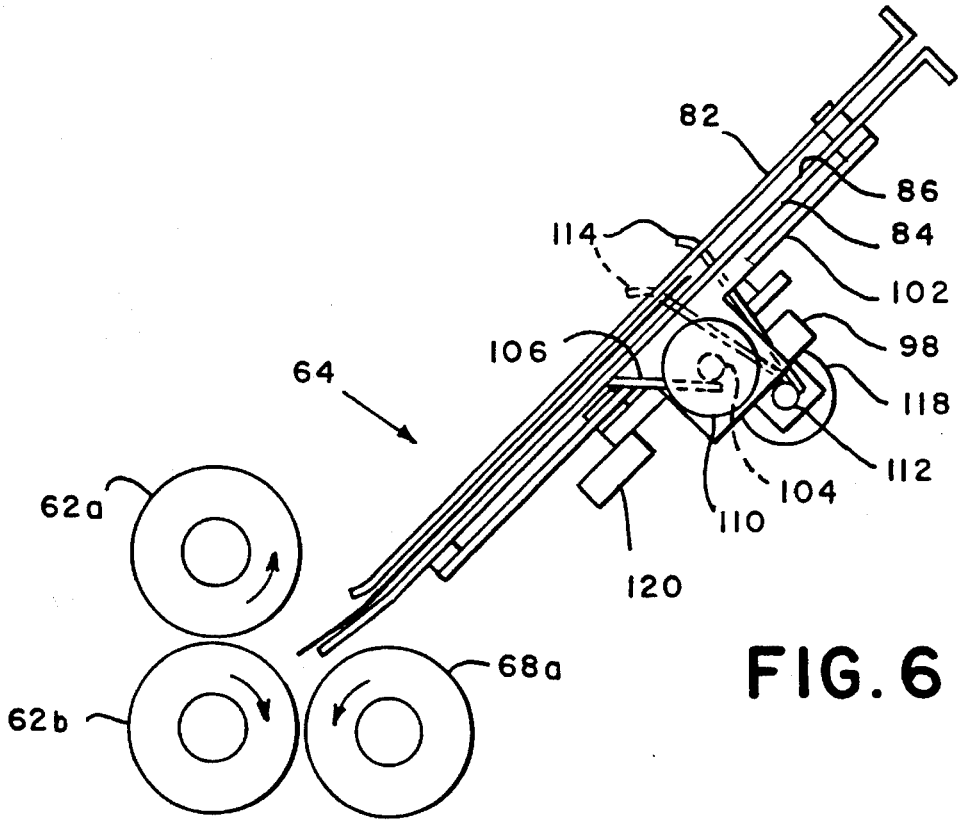
FIG. 6 is a view similar to FIG. 5 showing the lead edge of a sheet positioned beyond the sheet abutment fingers, which are shown in their second position, with the sheet ejecting fingers shown in solid lines in their first position and in dotted lines in their second position.

Referring back to the short sheets in the stacking device 44*b*, at the appropriate time as controlled by the system software, these are fed, again individually or in groups as desired, into the folding module 48 and are directed into the entrance opening of the upper buckle chute 64 in the same manner as the long sheets described above. However, when the system software commenced the feeding of the short sheets, it also caused energization of the solenoid 110 to rotate the shaft 104 to move the abutment fingers 106 from their first position extending across the sheet receiving space 86, as shown in FIG. 5, to their second position shown in FIG. 6 in which the abutment fingers 104 are out of the sheet receiving space 86 and therefore out of the path of movement of the short sheet or sheets, as the case may be. As a sheet moves through the buckle chute 64, the trail edge thereof moves out of contact with the rollers 62*a* and 62*b*, as seen in FIG. 6, and the lead edge thereof passes the sensor 120, which activates a suitable circuit to energize the solenoid 118, which thereby rotates the shaft 112 to abruptly move the ejecting fingers 114 from their first position shown in solid lines in FIG. 6 to their second position shown in dotted lines in FIG. 6. By appropriately timing the activation of the solenoid 118 by the sensor 120, the ejecting fingers 114 strike the lead edge of the sheet or sheets moving past the abutment fingers 106 with sufficient force to bounce the sheet or sheets back toward the entrance of the buckle chute 64 and into the nip of the rollers 62*b* and 68*a*. The rollers 62*b* and 68*a* then feed the sheet into the lower buckle chute 70, where the same operations as just described occur to move the sheet into and out of the lower buckle chute 70 and thence through the rollers 68*a* and 68*b*, which then feed the sheet into the staging unit 50 in the same manner as with the folded long sheets described above. Upon completion of the bouncing or ejecting operation for all of the short sheets involved in the individual customer's sequence of long and short sheets, the system software causes the solenoid 110 to be deenergized so that the abutment fingers 106 return to their first position preparatory for the next sequence of sheets to be processed for the next customer.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

I claim:

1. A sheet folding module for use in a sheet processing apparatus including feed means for feeding sheets having a lead edge along a feed path, said sheet folding module comprising:

A. at least one buckle chute disposed in operative association with the sheet feeding path of the sheet processing apparatus for receiving sheets fed thereto, said buckle chute having a pair of opposed planar walls disposed in closely spaced relationship to define a sheet receiving space therebetween, one lateral edge of said planar walls defining an entrance opening into said sheet receiving space, B. a plurality of feeding and folding rollers disposed adjacent said entrance opening into said sheet receiving space for feeding sheets into and out of said buckle chute for folding selected ones of said sheets, C. sheet abutment means movably mounted in said buckle chute and normally extending across said sheet receiving space in the sheet feeding path to arrest the movement of a long sheet fed into said sheet receiving space which is long enough to span the distance between said feeding and folding rollers so as to remain under the control of said feeding and folding rollers when the lead edge of the long sheet reaches said abutment means, D. sheet ejecting means movably mounted in said buckle chute adjacent to said abutment means and extending across said sheet receiving space in the sheet feeding path to eject, a short sheet which is too short to span the distance between said feeding and folding rollers and is not under the control of said feeding and folding rollers when the lead edge of the shod sheet reaches said abutment means, E. sensor means disposed along said buckle chute at a predetermined distance from said sheet ejecting means for detecting the lead edge of the short sheet, and F. actuating means in operative communication with said sensor means for moving said abutment means out of said sheet receiving space when a shod sheet is directed into said buckle chute and for thereafter actuating said sheet ejecting means to eject said shod sheet from said buckle chute after said sensor means detects the lead edge of the short sheet, whereby said short sheet are ejected from said buckle chute without being folded.

2. A sheet folding module as set forth in claim 1 wherein said sheet abutment means comprises a plurality of sheet abutment fingers mounted on said buckle chute for movement between a first position in which said sheet abutment fingers are disposed across said sheet receiving space in the sheet feeding path and a second position in which said sheet abutment fingers are disposed out of said sheet receiving space so as not to obstruct sheets in said sheet feeding path.

3. A sheet folding module as set forth in claim 2 wherein said sheet abutment means includes a first shaft rotatably mounted on said buckle chute and extending laterally of said direction of said sheet feeding path, said sheet abutment fingers being mounted on said shaft.

4. A sheet folding module as set forth in claim 3 wherein said sheet ejecting means comprises a plurality of sheet ejecting fingers mounted on said buckle chute for movement between a first position in which said sheet ejecting fingers are disposed in rearwardly spaced relationship to said sheet abutment fingers relative to said buckle chute when said sheet abutment fingers are in said first position, and a second position in which said sheet ejecting fingers are disposed in forwardly spaced relationship to said first position of said sheet ejecting fingers.

5. A sheet folding module as set forth in claim 4 wherein said sheet ejecting means includes a second shaft rotatably mounted on said buckle chute adjacent to said first shaft and extending laterally of said direction of said sheet feeding path said sheet ejecting fingers being mounted on said second shaft.

6. A sheet folding module as set forth in claim 5 wherein said actuating means comprises means for moving said sheet abutment fingers and said sheet ejecting fingers between said first and second positions, respectively, in a predetermined time sequence.

7. A sheet folding module as set forth in claim 6 where said means for moving said sheet abutment fingers and said sheet ejecting fingers comprises means for oscillating said first and second shafts in said predetermined time sequence.

8. A sheet folding module as set forth in claim 7 wherein said means for oscillating said first and second shafts comprises a pair of rotary solenoids mounted on said buckle chute, one solenoid operatively connected to each of said shafts, and means for energizing said solenoids in said predetermined time sequence.

9. A sheet folding module as set forth in claim 1 wherein

A. there are a plurality of said buckle chutes disposed in juxtaposition with one another and in operative association with said sheet feeding path, B. there are a plurality of pairs feeding and folding rollers disposed adjacent said entrance openings into said sheet receiving spaces for each of said buckle chutes for feeding individual sheets into and out of said buckle chutes and from one buckle chute to another, C. said sheet abutment means being movably mounted on each of said buckle chutes, D. said sheet ejecting means being movably mounted on each of said buckle chutes adjacent to said abutment means, E. said sensor means being disposed along each of said buckle chutes adjacent to and upstream in the direction of said sheet feeding path from said sheet ejecting means, and F. said actuating means being operable to move said abutment means out of each of said sheet receiving spaces when the short sheet is directed into each of said buckle chutes and for thereafter actuating said sheet ejecting means to eject the short sheet from said buckle chutes.

10. A sheet folding module for use in a sheet processing apparatus including a buckle chute, a pair of feed rollers for feeding sheets having a lead edge along a path of travel into the buckle chute and a pair of exit rollers for feeding the sheets out of the buckle chute, said sheet folding module comprising:

A. sheet abutment means movably mounted to said buckle chute and repositionable between a first position in interference with the path of travel and a second position not in interference with the path of travel, said sheet abutment means in said first position for arresting further downstream in the path of travel movement of a long sheet so that a buckle forms in the long sheet as the feed rollers continue to feed the long sheet and the buckle enters the nip of the exit rollers causing the exit rollers to fold and feed the long sheet out of the buckle chute, B. first actuating means for moving said sheet abutment means between said first and second positions, C. sheet ejecting means located downstream from said sheet abutment means and pivotally mounted to said buckle chute, said sheet ejecting means repositionable between a first position and a second position upstream in the path of travel from said first position of said sheet ejecting means where said first and second positions of said sheet ejecting means are in interference with the path of travel, said sheet ejecting means for ejecting from the buckle chute a short sheet having an insufficient length measured in the direction of the path of travel to span the distance between the feeding rollers and said abutment means, D. second actuating means for moving said sheet ejecting means between said first and second positions, E. sensor means disposed along said buckle chute at a predetermined distance upstream from said sheet ejecting means for detecting the lead edge of the short sheet, and F. control means in operative communication with said first actuating means, said second actuating means and said sensor means for causing said first actuating means to reposition said sheet abutment means from said first position to said second position when the short sheet is fed into the buckle chute and for causing said second actuating means to reposition said sheet ejecting means from said first position to said second position after said sensor means detects the lead edge of the short sheet forcing the short sheet out of the buckle chute and into the nip of the exit rollers so that the short sheet is fed out of the buckle chute without folding.

11. A sheet folding module as set forth in claim 10, wherein said sheet ejecting means includes a shaft rotatably mounted on the buckle chute to rotate between said first and second positions of said sheet ejecting means, and a plurality of ejecting fingers fixably mounted on said shaft.

12. A sheet folding module as set forth in claim 11, wherein said ejecting fingers strike the lead edge of the short sheet during the repositioning of said sheet ejecting means from said first position to said second position and as the lead edge of the short sheet moves past said abutment means.

13. A method of feeding sheets in a sheet folding module including a buckle chute, a pair of feed rollers for feeding sheets having a lead edge along a path of travel into the buckle chute, a pair of exit rollers for feeding the sheets out of the buckle chute, the method comprising the steps of:

A. setting a sheet abutment means movably mounted to said buckle chute and repositionable between a first position in interference with the path of travel and a second position not in interference with the path of travel to said first position for arresting further downstream in the path of travel movement of a long sheet so that a buckle forms in the long sheet as the feed rollers continue to feed the long sheet and the buckle enters the nip of the exit rollers causing the exit rollers to fold and feed the long sheet out of the buckle chute, B. setting said sheet abutment means to said second position for a short sheet having an insufficient length measured in the direction of the path of travel to span the distance between the feeding rollers and said abutment means, C. detecting the lead edge of the short sheet using a sensor means disposed along said buckle chute, and then D. causing a sheet ejecting means located downstream from said sheet abutment means and movably mounted to said buckle chute to reposition from a first position to a second position upstream in the path of travel from said first position of said sheet ejecting means where both said first and second positions of said sheet ejecting means are in interference with the path of travel so as to force the short sheet out of the buckle chute and into the nip of the exit rollers so that the short sheet is fed out of the buckle chute without folding.

14. A method of feeding sheets in a sheet folding module as set forth in claim 13, further including the step of the sheet ejection means striking the lead edge of the short sheet during the repositioning of said sheet ejecting means from said first position to said second position and as the lead edge of the short sheet moves past said abutment means.

* * * * *